United States Patent [19]

Birkle et al.

[11] 4,455,201

[45] Jun. 19, 1984

[54] BATH AND METHOD FOR ANODIZING ALUMINIZED PARTS

[75] Inventors: Siegfried Birkle, Hochstadt/A; Klaus Stoger, Nuremberg, both of Fed. Rep. of Germany; Hans De Vries, Heerde, Netherlands

[73] Assignee: Siemens Aktiengesellschaft, Munich, Fed. Rep. of Germany

[21] Appl. No.: 480,061

[22] Filed: Mar. 29, 1983

[30] Foreign Application Priority Data

Mar. 30, 1982 [DE] Fed. Rep. of Germany ..... 3211782

[51] Int. Cl.[3] ..... C25D 11/08; C25D 11/10

[52] U.S. Cl. ..... 204/58; 106/14.13; 106/14.14

[58] Field of Search ..... 204/58; 106/285, 287.26, 106/287.32, 14.13, 14

[56] References Cited

U.S. PATENT DOCUMENTS

| | | | |
|---|---|---|---|
| 1,869,042 | 7/1932 | Bengston | 204/58 |
| 3,252,875 | 5/1966 | Economy | 204/58 |

FOREIGN PATENT DOCUMENTS

| | | | |
|---|---|---|---|
| 30341 | 5/1974 | Japan | 204/58 |
| 409679 | 4/1934 | United Kingdom | 204/58 |

OTHER PUBLICATIONS

Handbook of Chem. & Phyics, Chem. Rubber Co., 1951, p. 1730.

Table of Conversion Factors, Hanson van Winkle Mining Co.

*Primary Examiner*—R. L. Andrews

*Attorney, Agent, or Firm*—Kenyon & Kenyon

[57] ABSTRACT

Aluminized parts are anodized in an aqueous bath which contains 1050 to 1040 g per L of sulfuric acid with a density of 1.84 and optionally 1 to 100 g of a polyhydroxy alcohol and 1 to 100 g of a multibasic organic acid. The anodizing is carried out at a pH value of less than 1 with a current density of 0.5 to 3 A/dm$^2$ at 0° to 30° C. The method can be used with partially aluminized parts without destroying the base material.

7 Claims, 2 Drawing Figures

BATH AND METHOD FOR ANODIZING ALUMINIZED PARTS

BACKGROUND OF THE INVENTION

The invention relates to a bath for anodizing aluminized parts, which is a formulated sulfuric acid aqueous solution and contains additives, as well as to a method for preparing anodizing layers, which is carried out using such a bath.

Aluminum materials and aluminum-coated parts are not yet resistant enough to oxidation and wear for many applications, although a resistant oxide coating which is stable in the pH range of 5 to 9 is produced in air. This oxide layer, however, is still too thin for many technical applications. Therefore, the layer can be reinforced in anodizing electrolytes.

Use of known acid anodizing baths to anodize partially aluminized articles such as ferrous materials not coated in contact areas, or those profiled parts having uncoated places which may exist due to the limited throwing power in non-aqueous aluminum baths and in the case of vapor deposition processes, requires covering the exposed areas with a so-called masking film prior to anodizing. Otherwise, the base material is dissolved anodically. After the anodizing, such varnishes must be removed either by stripping them off or dissolving them with a suitable solvent. In the case of cavities or holes in which there is no aluminum, the situation can be corrected by sealing them with plugs or the like. This procedure, while technically possible in principle, is technically expensive and uneconomical.

It is therefore an object of the invention to develop a bath for anodizing aluminized parts, in which the disadvantages described above do not occur and by means of which it is, in particular, possible to generate homogeneously coherent sufficiently thick oxide layers when the base material surface is not covered with aluminum on all sides.

SUMMARY OF THE INVENTION

These and other objects are achieved by the invention, which is directed to a composition of an aqueous anodizing bath which contains 1050 to 1400 g per L of pure sulfuric acid with a density of 1.84. This corresponds to about 70 to 80 mass percent.

The work pieces for example, those composed of iron, copper, and their alloys anodized by electroplating which are anodically oxidized with a bath according to the invention, no longer show anodic dissolution of the base material which would limit the application of the work piece.

Particularly advantageous results are obtained if the bath for anodizing contains, in addition, about 1 to 100 g of a polyhydroxy alcohol, preferably 10 to 30 g glycerin and 1 to 100 g of a multi-basic organic, aliphatic acid, particularly 1 to 80 g oxalic acid.

The invention is furthermore directed to a process for anodizing aluminized parts, using a bath of the composition given above, which operates this bath at a pH value of less than 1 and a current density of 0.5 to 3 A/dm$^2$ and preferably 0.5 to 1.5 A/dm$^2$ at 0 to 30° C.

DETAILED DESCRIPTION OF THE INVENTION

Figure 1:
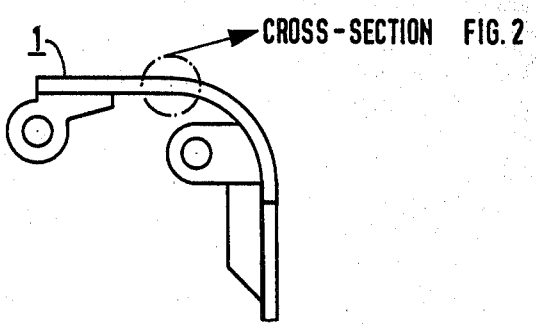
FIG. 1 illustrates a hinge section of an eye glass frame anodized according to the invention.
Figure 2:
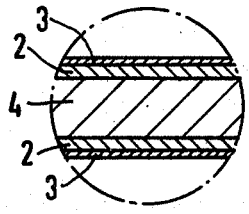
FIG. 2 illustrates a cross-section of the hinge section bar and points out the several layers thereof.

If the method according to the invention is used, it is possible to prepare a homogeneous Eloxal ® (Siemens registered trademark) layer within the above-mentioned current density range. It can be operated with d-c and pulsed current. The latter has been found to be particularly advantageous since more abrasion resistant layers will result therefrom.

This applies also to anodizing at temperatures of 0 to 20° C.

The method according to the invention is advantageous for anodizing base materials provided with flame sprayed aluminum layers, roll bonded aluminum layers, fired aluminum layers, PVD aluminum layers and particularly IVD aluminum layers, where the layers may be applied to the work piece also partially.

The method according to the invention is suited also for parts coated in aprotic media with "galvano-aluminum". "Galvano-aluminum" is a high-purity aluminum (better than 99.99%), having good electric conductivity and high ductility (20 HV) which is obtained by precipitation from organo-aluminum eletrolytes.

With a bath according to the invention and the method according to the invention, partially aluminized parts especially such as those made from ferrous, zinc and copper materials can be oxidized anodically without disadvantages to the application, such as dissolution of the base material, so that hard abrasion resistant oxide layers are produced which can be stained.

The invention will be explained in greater detail with the aid of the examples and the drawings.

The figures show in cross section an embodiment example of a hinge 1 of a spectacle frame of German Silver 4 which has an aluminum layer 2. The oxide layer applied thereon according to the invention is designated with 3.

EXAMPLE 1

Anodized Steel Sheets

Six profiled test specimens of the base material Steel ST 37 were aluminized after an aqueous pretreatment, using a $Na(Al_2(C_2H_5)_6F)$.3.4 mol toluol electrolyte at 100° C. for 1½ hours with a current density of 1 A/dm$^2$. The layer thickness distribution of the galvano-aluminum layer on the test specimens differed greatly.

The test specimens 1 to 3 were anodically oxidized (G.S. process) and stained with an organic water-soluble stain. Conditions were as follows.

| | |
|---|---|
| Electrolyte | 20% by weight sulfuric acid |
| Temperature | 18° C. |
| Voltage | 18 V |
| Current density | 1.5 A/dm$^2$ |
| oxidizing time for test specimen | 15 min. |
| oxidizing time for spectacle frames | 1 min. |
| Stain | Sandoz Blue 2 LV |
| Staining time | 5 min. at 55° C. |

The test specimens 4 to 6 were anodically oxidized in accordance with the method as per the invention and were likewise stained as above. Conditions were as follows.

| | |
|---|---|
| Electrolyte | 1250 g/l concentrated $H_2SO_4$, chemically pure |
| Oxalic acid | 60 g/l |
| Glycerin | 20 ml/l |
| Temperature | 15° C. |
| Voltage | 18 V |
| Current density | 1.5 A/dm$^2$ |
| Eloxadizing time | 30 min. |
| Stain | Sandoz Blue 2 LW |
| Staining time | 10 min. at 55° C. |

While the test specimens 1 to 3 showed heavy pitting in the depressions after an oxidizing time of 15 min. and could no longer be stained decoratively, the test specimens 4 to 6 showed almost no corrosion phenomena and were of perfect appearance. After 30 min. the thickness of the Eloxal® (Siemens Trademark) layer is about 10 pm.

EXAMPLE 2

Silver Frames 6 spectacle frames of German silver were aluminized as indicated in Example 1. Of them, three spectacle frames were anodized by the GS process of Example 1 and three with the electrolyte according to the invention (see Example 1). While the spectacle frames anodically oxidized by the GS process showed heavy pitting at the hinges already after about one minute, the other three frames (4 to 6) were perfect.

What is claimed is:

1. A composition for use as a bath for anodizing metallic parts comprising a sulfuric acid aqueous solution of about 1050 to about 1400 g per liter of pure sulfuric acid with a density of 1.84, and about 10 to about 30 g per liter of a polyhydroxy alcohol selected from glycol, glycerin and pentaerythritol and about 1 to about 100 g per liter of a multibasic aliphatic acid selected from an n-alkadioic acid of 2 to 8 carbons.

2. A bath according to claim 1, wherein the bath contains 10 to 30 g glycerin and 1 to 80 g oxalic acid per liter.

3. A process for anodizing aluminum coated metallic parts comprising anodically oxidizing the aluminum coating in a sulfuric acid aqueous solution bath containing about 1050 g to about 1400 g per liter of pure sulfuric acid with a density of 1.84, about 10 to about 30 g per liter of a polyhydroxy alcohol selected from glycol, glycerin and pentaerythritol, and about 1 to about 100 g per liter of a multibasic aliphatic acid selected from n-alkadioic acid of 2 to 8 carbons, at a pH value of less than 1 and a current density of 0.5 to 3 A/dm$^2$ at 0 to 30° C.

4. A process according to claim 3 wherein the alcohol is gylcerine and about 1 to 80 g oxalic acid is present.

5. A method according to claim 3, comprising oxidizing with a current density of 0.5 to 1.5 A/dm$^2$.

6. A method according to claim 3, comprising oxidizing at a temperature of 0 to 20° C.

7. Use of the process according to claim 3 for anodizing metallic parts partially coated with galvano-aluminum, PVD aluminum or roll bonded aluminum.

* * * * *